US010456892B2

(12) United States Patent
Butler

(10) Patent No.: US 10,456,892 B2
(45) Date of Patent: Oct. 29, 2019

(54) MANHOLE COVER LIFTING TOOL

(71) Applicant: MANUP KEY LIMITED, Pontypridd (GB)

(72) Inventor: Andrew Butler, Pontypridd Mid Glamorgan (GB)

(73) Assignee: Manup Key Limited (GB)

( * ) Notice: Subject to any disclaimer, the term of this patent is extended or adjusted under 35 U.S.C. 154(b) by 0 days.

(21) Appl. No.: 16/068,722

(22) PCT Filed: Nov. 2, 2016

(86) PCT No.: PCT/GB2016/053399
§ 371 (c)(1),
(2) Date: Jul. 9, 2018

(87) PCT Pub. No.: WO2017/118833
PCT Pub. Date: Jul. 13, 2017

(65) Prior Publication Data

US 2019/0022830 A1 Jan. 24, 2019

(30) Foreign Application Priority Data

Jan. 8, 2016 (GB) ..... 1600312.1

(51) Int. Cl.
*B25B 9/00* (2006.01)
*E02D 29/14* (2006.01)

(52) U.S. Cl.
CPC ..... *B25B 9/00* (2013.01); *E02D 29/1445* (2013.01)

(58) Field of Classification Search
CPC ..... B66F 15/00; B66F 19/00; B66F 2700/02; B66F 2700/09; A01B 1/00; A01B 1/02; E02D 3/00
See application file for complete search history.

(56) References Cited

U.S. PATENT DOCUMENTS 2,047,485 A * 7/1936 McBrady ..... A01B 1/022 294/57
2,085,382 A * 6/1937 Nebor ..... E01H 5/02 172/381
3,985,338 A 10/1976 Herrmann
4,072,335 A 2/1978 Tift et al.
(Continued)

FOREIGN PATENT DOCUMENTS

DE 3921366 1/1991
DE 19517130 12/1995
DE 20304863 7/2003

OTHER PUBLICATIONS

International Search Report and Written Opinion for Application No. PCT/GB2016/053399 dated Jan. 30, 2017.
(Continued)

*Primary Examiner* — Lee D Wilson
(74) *Attorney, Agent, or Firm* — Tumey L.L.P.

(57) ABSTRACT

A manhole cover lifting tool is disclosed. The tool comprises an elongate body and a shaft which is arranged to slide relative the body. The tool further comprises coupling means for slidably coupling a proximal region of the shaft with the body and means disposed at a distal region of the shaft for detachably coupling the shaft with a manhole cover, such that the shaft is restricted to slide through a pre-defined range along the body.

11 Claims, 3 Drawing Sheets

(56) References Cited

U.S. PATENT DOCUMENTS

| | | | | |
|---|---|---|---|---|
| 5,775,674 | A * | 7/1998 | Bigham | B66F 15/00 254/130 |
| 6,964,407 | B1 * | 11/2005 | Butler | B66F 19/005 254/131 |
| 10,058,990 | B1 * | 8/2018 | Logan | A01B 1/02 |
| 2002/0053261 | A1 * | 5/2002 | Arturo | E04D 15/003 81/45 |
| 2005/0242599 | A1 * | 11/2005 | Demar | A01B 1/02 294/60 |
| 2011/0113929 | A1 * | 5/2011 | Lemelin | B25D 1/02 81/22 |

OTHER PUBLICATIONS

Great Britain Search Report for Application No. GB1600312.1 dated Jun. 24, 2016.

* cited by examiner

MANHOLE COVER LIFTING TOOL

The present invention relates to a manhole cover lifting tool.

When lifting manhole covers to provide access to underground ducts and passageways, it is common to use a tool 1 comprising a handle 2 and an elongate shaft 3 with a key 4 disposed at a distal end thereof, as illustrated in FIG. 1 of the drawings. The key is arranged to pass within an aperture formed within the cover when the key is arranged in a first rotational configuration, and upon rotating the tool, the key is arranged to engage with an underside of the cover so that upon lifting the tool, the cover can be lifted also.

However, manhole covers are typically sited within a frame which extends around the opening to the underground duct or passageway and owing to the floor mounted nature of manhole covers, grit and dirt for example is found to collect within the narrow gap between the frame and the manhole cover. The grit and dirt can wedge the cover within the frame and as such, when applying an upward force to the manhole cover using the tool, a further operator is often required to strike the cover with a hammer or the like to dislodged the grit and dirt and thus free the cover from the frame.

We have now devised a manhole cover lifting tool which obviates the requirement for two operators and the need to strike the cover while lifting.

In accordance with the present invention, there is provided a manhole cover lifting tool, the tool comprising an elongate body and a shaft which is arranged to slide relative to the body, the tool further comprising coupling means for slidably coupling the shaft with the body and means disposed on the shaft for detachably coupling the shaft with a manhole cover, wherein the shaft is restricted to slide through a pre-defined range relative to the body.

In an embodiment, the coupling means is arranged to couple the shaft at a proximal region thereof to the body.

In an embodiment, the means for detachably coupling the shaft with the manhole cover is disposed at a distal end of the shaft.

In an embodiment, the body comprises a bore and the shaft is arranged to slide along the body within the bore. Preferably, the shaft comprises a substantially linear configuration and is arranged to extend along a longitudinal axis of the body.

In an embodiment, the means disposed at the distal region of the shaft comprises a key. The key is arranged to pass through the aperture when configured in a first rotational orientation relative to the aperture, and is prevented from passing through the aperture when configured in a second rotational orientation relative to the aperture.

In an embodiment, the key comprises a substantially planar cross-piece which extends transverse to a longitudinal axis of the shaft. Preferably, the cross-piece extends in a plane comprising a longitudinal axis of the shaft, and comprises a first and second shoulder which extend outwardly of the shaft along a diameter thereof.

In an embodiment, the coupling means comprises a pin, which extends substantially transverse to the shaft, through a first and second elongate channel formed within the body. The first and second channels preferably extend substantially parallel to a longitudinal axis of the body and are formed at diametrically opposite sides of the body. The pin is arranged to extend through an aperture formed within a proximal region of the shaft and the first and second channels, such that the shaft is permitted to slide relative to the body through a distance corresponding to a length of the channels. In this respect, the pre-defined range comprises the length of the channels.

In an embodiment, the tool further comprises a handle disposed at a proximal end of the body for enabling a user to suitably grip the tool and manipulate the body and shaft.

Whilst the invention has been described above, it extends to any inventive combination of features set out above or in the following description. Although illustrative embodiments of the invention are described in detail herein with reference to the accompanying drawings, it is to be understood that the invention is not limited to these precise embodiments.

Furthermore, it is contemplated that a particular feature described either individually or as part of an embodiment can be combined with other individually described features, or parts of other embodiments, even if the other features and embodiments make no mention of the particular feature. Thus, the invention extends to such specific combinations not already described.

The invention may be performed in various ways, and, by way of example only, embodiments thereof will now be described, reference being made to the accompanying drawings in which.

Figure 1:
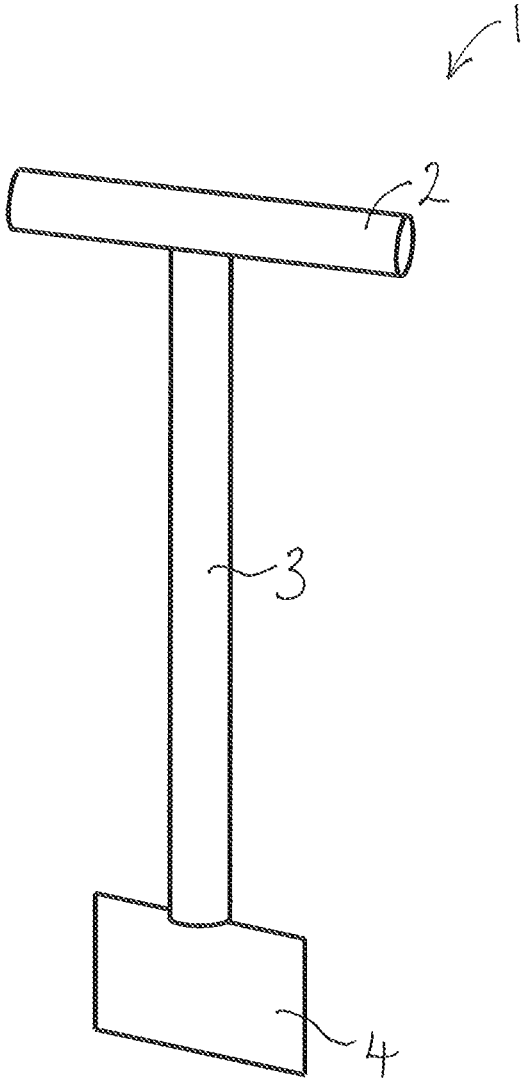
Figure 1 (Prior Art)
FIG. 1 is a perspective view of a known manhole cover lifting tool.
Figure 2:
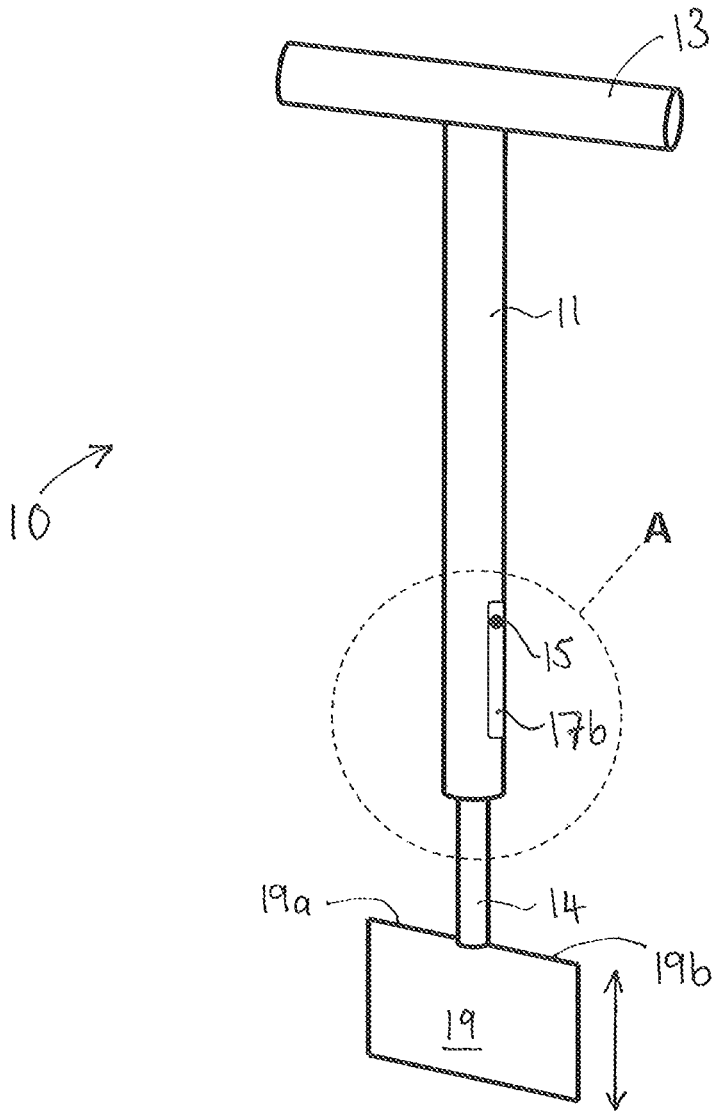
FIG. 2 is perspective view of a manhole cover lifting tool according to an embodiment of the present invention; and, FIG. 3 is sectional view of the region of the tool shown circled and labelled as "A" in FIG. 2.
Figure 3:
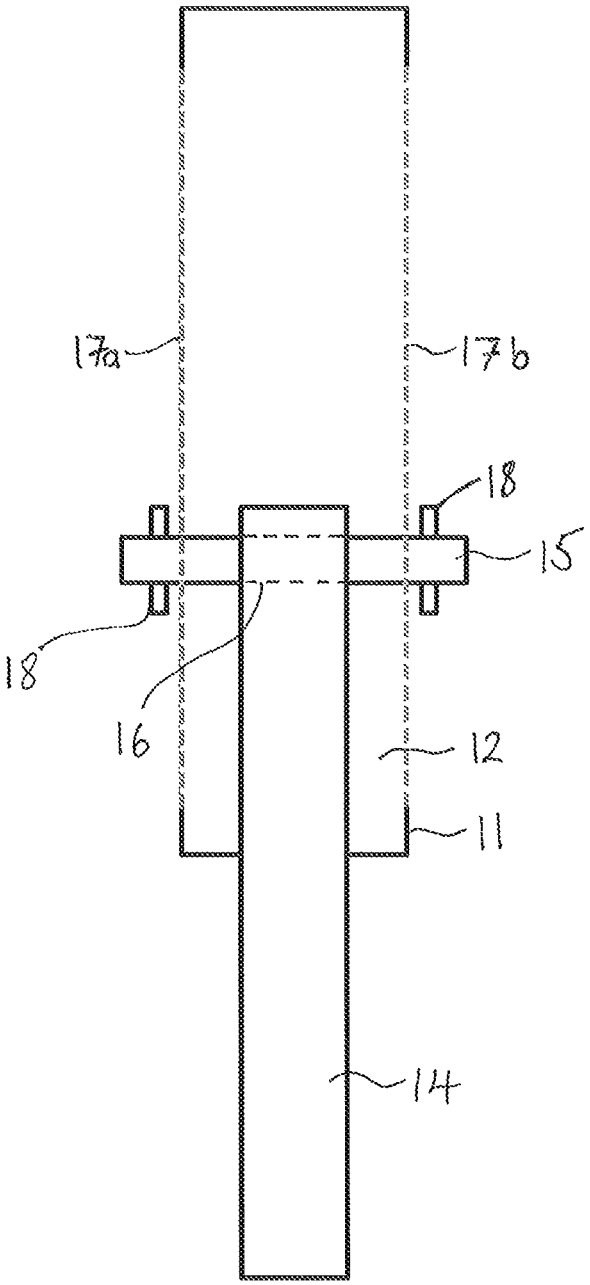

Referring to FIGS. 2 and 3 of the drawings, there is illustrated a manhole cover lifting tool 10 according to an embodiment of the present invention, for lifting covers (not shown) for openings to underground ducts and passageways. The tool 10 comprises an elongate body 11 which may be formed of a metal such as steel, or a rigid plastics material, such as poly vinyl chloride. The body 11 is substantially linear and comprises a bore 12 (as illustrated in FIG. 3) which extends along the body 11, substantially along a longitudinal axis of the body 11. The tool 10 further comprises a handle 13 rigidly coupled to a proximal end of the body 11. The handle 13 extends substantially transverse to the axis of the body 11 and enables an operator (not shown) to suitably manipulate the tool 10.

The bore 12 comprises a substantially circular cross-sectional shape although the skilled reader will recognise that other cross-sectional shapes may also be used, and is arranged to receive an elongate shaft 14. The shaft 14 is arranged to slide within the bore 12 along the longitudinal axis and comprises a cross-sectional shape which substantially conforms with an internal shape of the bore 12. The shaft 14 is coupled at a proximal region thereof to the body 11 via coupling means. The coupling means comprises a pin 15 or similar which is arranged to extend across the shaft 14, through a port 16 formed therein. The pin 15 is arranged to extend along a diameter of the shaft 14 and extends outwardly of the shaft 14 from either side thereof. Opposite ends of the pin 15 are arranged to extend through a respective, elongate channel 17 formed within the body 11, such that distal ends of the pin 15 extend out from the body 11. In this respect, the body 11 comprises two elongate channels 17*a*, 17*b* formed diametrically opposite each other within the body 11. The channels 17 extend along the body 11 substantially parallel to the longitudinal axis of the body 11, such that the pin 15 and channels 17 cooperatively define a distance through which the shaft 14 can slide relative to the body 11. Moreover, the pin 15 and channels 17 serve to rotationally couple the body 11 to the shaft 14. The coupling means further comprises a locking clip 18 or fastener detachably coupled to the distal ends of the pin 15, outside of the body 11, in order to prevent the pin 15 from passing out from the channels 17 and the port 16.

The shaft 14 further comprises a key 19 disposed at a distal region of the shaft 14 which is arranged to detachably couple with a manhole cover (not shown). The key 19 comprises a substantially planar cross-piece which extends in substantially the same plane of the shaft 14 and comprises a first and second shoulder 19*a*, 19*b* which extend outwardly of the shaft 14 along a diameter thereof. In use, when it is desired to remove a manhole cover, the key 19 is suitably orientated with respect to an aperture (not shown) formed within a top section of the manhole cover, so that the cross-piece 19 can extend through the aperture (not shown). The key 19 is then inserted through the aperture and the tool 10 is manipulated using the handle 13, to cause the key 19 to rotate so that the cross-piece engages with an underside of the top section of the manhole cover. In this configuration, the shaft 14 cannot be removed from the cover (not shown) by simply lifting the tool 10.

The operator subsequently lifts the handle 13 and thus the body 11 quickly to impart an upward momentum to the body 11. As the body is lifted, the shaft 14 remains stationary owing to the slidable coupling of the body 11 to the shaft 14. However, when the body 11 has moved through a predefined distance relative to the shaft 14 (namely a distance corresponding to the length of the channels 17), the pin 15 will locate with a distal end of each channel 17 and the momentum gained by the body 11 will be at least partly transferred to the shaft 14, which generates a upward force on the manhole cover (not shown). This sudden impact acts to dislodge any debris from between the cover (not shown) and the frame (not shown) and frees the cover from the frame (not shown). With the cover free, the handle 13 can then be further lifted to lift the cover out from the frame (not shown).

Once the cover has been suitably removed, the key 19 is then rotated to suitably align the cross-piece 19 relative to the aperture within the manhole cover (not shown) so that the key 19 and thus the shaft 14 can be lifted out from the aperture.

From the foregoing therefore, it is evident that the tool provides a simple yet effective means of removing manhole covers from within the cover frame.

What is claimed:

1. A manhole cover lifting tool, the tool comprising an elongate body and a shaft which is arranged to slide relative to the body, the tool further comprising coupling means for slidably coupling the shaft with the body and means disposed on the shaft for detachably coupling the shaft with a manhole cover, wherein the shaft is restricted to slide through a pre-defined range along the body characterised wherein the coupling means comprises a pin, which extends substantially transverse to the shaft, and a first and second elongate channel formed within the body and wherein the pin is arranged to extend through an aperture formed within a proximal region of the shaft and the first and second channels, such that the shaft is permitted to slide relative to the body through a distance corresponding to a length of the channels.

2. A manhole cover lifting tool according to claim 1, wherein the coupling means is arranged to couple the shaft at a proximal region thereof to the body.

3. A manhole cover lifting tool according to claim 1, wherein the means for detachably coupling the shaft with the manhole cover is disposed at a distal end of the shaft.

4. A manhole cover lifting tool according to claim 1, wherein the body comprises a bore and the shaft is arranged to slide along the body within the bore.

5. A manhole cover lifting tool according to claim 1, wherein the shaft comprises a substantially linear configuration and is arranged to extend along a longitudinal axis of the body.

6. A manhole cover lifting tool according to claim 1, wherein the means disposed at the distal region of the shaft comprises a key.

7. A manhole cover lifting tool according to claim 6, wherein the key is arranged to pass through the aperture when configured in a first rotational orientation relative to the aperture, and is prevented from passing through the aperture when configured in a second rotational orientation relative to the aperture.

8. A manhole cover lifting tool according to claim 6, wherein the key comprises a substantially planar cross-piece which extends transverse to a longitudinal axis of the shaft.

9. A manhole cover lifting tool according to claim 8, wherein the cross-piece extends in a plane comprising a longitudinal axis of the shaft, and comprises a first and second shoulder which extend outwardly of the shaft along a diameter thereof.

10. A manhole cover lifting tool according to claim 1, wherein the first and second channels extend substantially parallel to a longitudinal axis of the body and are formed at diametrically opposite sides of the body.

11. A manhole cover lifting tool according to claim 1, further comprising a handle disposed at a proximal end of the body for enabling a user to suitably grip the tool and manipulate the body and shaft.

* * * * *